United States Patent [19]

Stevens et al.

[11] 4,013,523

[45] Mar. 22, 1977

[54] TIN-GOLD ELECTROPLATING BATH AND PROCESS

[75] Inventors: Peter Stevens, Parsippany; John Martin Deuber, Nutley; Kathleen Regina Rosikiewicz, Landing, all of N.J.

[73] Assignee: Oxy Metal Industries Corporation, Warren, Mich.

[22] Filed: Dec. 24, 1975

[21] Appl. No.: 644,236

[52] U.S. Cl. ..... 204/43 G
[51] Int. Cl.[2] ..... C25D 3/62
[58] Field of Search ..... 204/43 G, 46 G, 123, 204/43 S

[56] References Cited

UNITED STATES PATENTS

| | | | |
|---|---|---|---|
| 1,905,105 | 4/1933 | Kersten | 204/43 G X |
| 3,598,706 | 8/1971 | Freedman et al. | 204/46 G |

*Primary Examiner*—G. L. Kaplan
*Attorney, Agent, or Firm*—Arthur E. Kluegel; Richard P. Mueller; B. F. Claeboe

[57] ABSTRACT

Disclosed is an aqueous electroplating bath suitable for plating a tin-gold alloy and a process of plating employing that bath. The bath contains gold as the auricyanide complex and tin as a stannic halide complex. The bath is operated at a pH value not in excess of 3. Where desired, the bath also contains a brightener. The electroplating bath is extremely stable and produces high quality electrodeposits.

10 Claims, No Drawings

TIN-GOLD ELECTROPLATING BATH AND PROCESS

BACKGROUND OF THE INVENTION

This invention relates to the art of electroplating a tin-gold alloy deposit. More specifically, it relates to the art of obtaining such a deposit employing an aqueous electroplating bath of improved stability which produces a high quality deposit.

Electroplating baths suitable for depositing a tin-gold alloy have been proposed, for example, in U.S. Pat. No. 3,764,489. The patantee was primarily concerned with preventing the oxidation of stannous ions in the plating bath to stannic ions. According to the patantee, when this oxidation occurs the resulting stannic ions will not codeposit from the plating solution. Thus, the patentee proposes to employ in the electroplating bath a stable stannous compound, a complexing agent which serves to complex with the stannous ions, monovalent gold in the form of the aurocyanide. Further according to the patantee soluble tin anodes are indispensable. The preferred pH range is from about 3.5 to about 5.5.

The deposition of tin-gold alloys has also been proposed in U.S. Pat. No. 1,905,105 by use of an aqueous electroplating solution employing a gold aurocyanide and alkali metal stannates or stannites.

The use of auricyanide compounds in a plating bath at a pH of 1 to 3 has been disclosed in U.S. Pat. No. 3,598,706.

SUMMARY OF THE INVENTION

It has now been discovered that an aqueous bath containing tri-valent gold in the form of the auricyanide complex and tin as a stannic halide complex, if adjusted to a pH value of not in excess of 3, will produce high quality deposits of a tin-gold alloy while exhibiting enhanced stability compared to plating baths developed heretofor. Where brightness is desired, the bath preferably contains a brightener.

DETAILED DESCRIPTION OF THE INVENTION

The major problem which has been encountered in prior attempts to deposit alloys of tin and gold has been the instability of the aqueous electroplating bath. Prior publications have, for the most part, suggested the use of stannous ions as a source of tin. The major problem with such systems has been to avoid the oxidation of the stannous ion to stannic ion by either atmospheric oxygen or anode oxidation. Once the stannic ion was present, it would readily hydrolyze to form insoluble basic salts of tin. These insoluble salts would then settle on the workpiece being electroplated or interfere with the electroplating bath in other ways so that the bath has to be replaced by a fresh bath. A second problem, of course, has been to maintain the potential of the gold and tin compounds employed sufficiently close so that the deposit obtained would contain the desired ratios of tin and gold rather than just one metal or the other.

According to the present invention, an aqueous electroplating bath containing tri-valent gold has the auricyanide complex and tin as a stannic halide complex, when adjusted to a pH not in excess of 3, will yield tin-gold alloy deposits of good quality. This bath also has the important advantage of being very stable in spite of the normal ease with which tin ions undergo hydrolysis and/or redox reactions.

Gold in the present aqueous electroplating bath should be present as the auricyanide complex. The gold may be added to the plating bath in any form which will yield the complex, e.g., as the acid or in the form of the alkali metal or ammonium salt. In view of the high cost of gold, the gold concentration in the plating bath will normally be kept at a relatively low level in order to avoid excess cost due to drag-out. From 1 to 30 grams/liter of gold is normally sufficient with from 1 to 16 grams/liter being preferred.

The tin component of the plating bath should be present as a stannic halide complex. It may be supplied directly as a stannic halide complex or the complex may be formed in situ by the separate addition of a soluble stannic or stannate compound and a soluble halide compound. Of the halides, fluoride, chloride and bromide are preferred with chloride being the most preferred for ease of handling, low cost and low toxicity. Where added separately, suitable halide compounds include, for example, the halide acids and their alkali metal and ammonium salts. Where separately added, the tin may be supplied, for example, as an alkali metal or ammonium stannate, stannic oxide, stannic halide or a stannic alkali metal or ammonium halide. Whether the tin and halide components are added separately or, preferably as the stannic halide complex itself, the concentrations employed should be sufficient to provide 1 – 150 g/l of the halide complex (expressed as tin equivalent) and preferably 10 – 40 g/l.

It is critical to the stability of the plating bath, that the pH be maintained at a value not in excess of 3. It has been found that at pH values in excess of 3 the tin compound, whether present as the stannous, stannic or stannic complex, will hydrolyze to form insoluble basic tin salts.

If the gold is present as the aurocyanide at a pH of less than 3, precipitation of AuCN will occur. At pH's of below 3, a combination of the auricyanide and stannous salt will result in a redox reaction and corresponding precipitates. If a bath is prepared containing the auricyanide and a stannic salt in uncomplexed form, the bath will not be stable even at pH values of below 3. Accordingly, it is critical to this invention that both the tin and the gold be present in their highest oxidation states, that the tin be present as a stannic halide complex, and that the pH value of the bath is adjusted to a value not in excess of 3. Preferably, the bath will be adjusted to a pH value of not in excess of 1.

The pH adjustment may be accomplished with any suitable non-reactive acids or bases (e.g., common mineral acids and bases). Most conveniently, the hydrohalogen acid corresponding to the halide of the stannic complex is employed to lower the pH value where necessary. This component, therefore, functions not only to lower the pH value but to provide excess halide ion in order to maintain the tin present in the form of the stannic halide complex, as much as possible. Ammonium or alkali metal hydroxides may be suitably employed to raise pH if necessary.

One or more additional components may be included in the aqueous plating bath depending upon the qualities desired of the resulting tin-gold deposit. Excess halide ion may be added in any soluble form such as the ammonium or alkali metal simple or complex salts. If desired, for the alloying components commonly employed in gold plating may be included such as indium, silver and the Group VIII transition metals. Complexing agents such as phosphonics and EDTA analogs (e.g.

Quadrol) may be included where desired. Brightness of the deposit may be enhanced by including at least 0.01 grams/liter of a surfactant. Non-ionic surfactants are preferred but, an ionic and amphoteric surfactants have also been found effective. Examples of suitable surfactants are setforth in Table I.

TABLE I

SURFACTANTS

| Compound | Supplier |
|---|---|
| Aquet<br>alkylaryl polyethylene glycol | Monostat |
| Carbowax 300<br>polyethylene oxide | Union Carbide |
| Emulphogene BC 720<br>tridecyloxy poly(ethylene-oxy)ethanol | GAF |
| Ethylan CD 916<br>isopropyl lanolate | Robinson, Wagner |
| Neutronyx 656<br>alkylphenol polyglycol ether | Onyx Chemical |
| Trycol LAL 8<br>ethoxylated fatty alcohol ether | Emery Ind. |
| Trycol LAL 23<br>ethoxylated fatty alcohol ether | Emery Ind. |
| Triton X100<br>octylphenoxy polyethoxy ethanol | Rohm & Haas |
| Triton X102<br>octylphenoxy polyethoxy ethanol | Rohm & Haas |
| Zonyl A<br>ethylene oxide ester condensate | Du Pont |
| Zonyl FSN<br>fluorochemical surfactant | Du Pont |
| Triton QS-15<br>amphoteric taurine type surfactant | Rohm & Haas |
| Calfoam ES-30<br>sodium salt of lauryl ether sulfate | Pilot Chemical |

It has also been found that the brightness of the deposit can be further improved by the addition of known brighteners such as those useful as nickel brighteners. Nickel brighteners are described, for example, in the Metal Finishing Guidebook (1975), Metals & Plastics Publications Inc., Pgs. 266 to 268 and Plating, V46, Pgs. 610 to 612, June 1959. These brighteners generally include various sulfur containing unsaturated organic compounds, e.g., allyl or aryl sulfonates and sulfonamides as well as aldehydic, olefinic and acetylenic compounds. Examples of suitable brighteners are saccharin, butynediol; chloral hydrate, chloraniline, o-ethyl toluidine, aldol, and ascorbic acid.

Suitable operating conditions may be selected as follows:

| Current Density | Bath Temperature | pH Value | Anodes |
|---|---|---|---|
| 1 – 100 amps/sq. ft. | Room Temperature to 150 F. | 3 or less | Insoluble |

The following examples are intended to illustrate and not to limit the scope of the invention.

EXAMPLE 1

An aqueous plating bath as prepared to contain the following:

| COMPONENT | CONCENTRATION |
|---|---|
| $(NH_4)_2SnCl_6$ | 20 g/l tin equiv. |
| $KAu(CN)_4$ | 4 g/l gold equiv. |
| Triton QS-15 | 0.5 ml/l |
| Saccharin | 0.5 g/l |

The bath was adjusted to a pH of 0.7 with hydrochloric acid. A brass cathode was immersed in the bath at 90° F. and a current density of 20 amps/sq. ft. A white, almost fully bright adherent deposit was obtained which contained upon analysis 80% gold and 20% tin. The plating efficiency was 25 to 30 mg/amp. min.

EXAMPLE 2

A bath was prepared for dissolving in water:

| Component | Concentration |
|---|---|
| $(NH_4)_2SnCl_6$ | 20 g/l tin equiv. |
| $KAu(CN)_4$ | 4 g/l gold equiv. |
| Trycol LAL-8 (5%) | 10 ml/l |
| Quadrol (10%) | 10 ml/l |
| Ascorbic acid (10%) | 2 ml/l |
| 2 butyne-1, 4 diol (5%) | 1 ml/l |

At a pH of 0.6, bright white tin-gold alloy deposits were obtained. The bath was operated for over one week with periodic replenishment (25 turn-overs) and was still stable. The same bath where the stannic component was not present as the halide complex decomposes within hours.

Semi-bright to bright deposits were obtained when the concentration of the tin complex was varied from 10 to 60 g/l (tin equiv.) and when the gold was varied from 2 to 8 g/l (gold equiv.). Deposits were white at higher tin to gold ratios and yellowish at lower ratios.

EXAMPLE 3

A bath was prepared by dissolving in water:

| Component | Concentration |
|---|---|
| $SnCl_4$ | 20 g/l tin equiv. |
| $NH_4HF_2$ | 220 g/l |
| $KAu(CN)_4$ | 2 g/l gold equiv. |
| Trycol LAL-8 (5%) | 10 ml/l |
| Ascorbic acid (10%) | 2 ml/l |
| 2 butyne-1, 4 diol (5%) | 1 ml/l |

At a pH of 2.0 slightly yellowish semi-bright deposits were obtained and the bath was stable.

EXAMPLE 4

To the bath of Example 2 was added 100 mg/l of indium as the sulfate. Under the conditions of Example 2 an alloy deposit was obtained which contained

| | |
|---|---|
| Gold | 94% |
| Tin | 5.9% |
| Indium | 0.12% |

EXAMPLE 5

To the bath of Example 2 was added 6 mg/l of silver as the chloride. Under the conditions of Example 2 an alloy deposit was obtained which contained

| | |
|---|---|
| Gold | 93% |
| Tin | 6.7% |
| Silver | 0.22% |

We claim:

1. An aqueous bath suitable for the electrodeposition of an alloy of tin and gold, comprising

| | |
|---|---|
| gold as the auricyanide | 1–30 g/l gold equiv. |
| tin as a stannic halide complex | 1–150 g/l tin equiv. |

wherein the halide is selected from the group consisting of fluoride, chloride and bromide, the bath exhibiting a pH value not in excess of 3.

2. The bath of claim 1 wherein the gold concentration is 1–16 g/l and the tin concentration is 10–40 g/l.

3. The bath of claim 1 containing sufficient quantity of the hydrohalogen acid corresponding to the halide of the stannic complex to attain the desired pH value.

4. The bath of claim 1 adjusted to a pH value not in excess of 1.

5. The bath of claim 1 additionally comprising at least 0.01 g/l of a surfactant.

6. The bath of claim 5 wherein said surfactant is non-ionic.

7. The bath of claim 5 wherein said surfactant is a polyethoxylated fatty alcohol containing 6 to 23 ethoxy groups.

8. The bath of claim 1 additionally containing at least 0.01 g/l of a brightener.

9. The bath of claim 1 additionally containing at least 0.01 g/l of a further alloying element.

10. A process of plating a tin-gold deposit on a conductive substrate comprising electrolyzing the solution of claim 1 with the substrate as cathode.

* * * * *